US006463602B1

(12) United States Patent
Patella

(10) Patent No.: US 6,463,602 B1
(45) Date of Patent: Oct. 15, 2002

(54) SOFA BED COMPRISING INNOVATING MECHANISMS FOR POSITION ADJUSTMENT AND QUICK ASSEMBLY

(75) Inventor: Pino Patella, Altamura (IT)

(73) Assignee: Gruppo Industriale Styling Srl, Altamura (IT)

( * ) Notice: Subject to any disclaimer, the term of this patent is extended or adjusted under 35 U.S.C. 154(b) by 0 days.

(21) Appl. No.: 09/574,508

(22) Filed: May 19, 2000

(51) Int. Cl.[7] ..... A47C 17/14
(52) U.S. Cl. ..... 5/12.1; 5/12.2; 5/13
(58) Field of Search ..... 5/12.1, 12.2, 13, 5/14, 29, 28, 30–36

(56) References Cited

U.S. PATENT DOCUMENTS 3,925,834 A * 12/1975 Johnson et al. ..... 5/13
4,032,999 A * 7/1977 Pringle ..... 5/14
4,480,344 A * 11/1984 Padovan ..... 297/111
5,097,544 A * 3/1992 Barabas ..... 5/13
5,644,804 A * 7/1997 Wang ..... 5/12.1

* cited by examiner

*Primary Examiner*—Heather Shackelford
*Assistant Examiner*—Fredrick Conley
(74) *Attorney, Agent, or Firm*—Herbert Dubno

(57) ABSTRACT

Sofa bed comprising innovating mechanisms for position adjustment and quick assembly. It comprises padding elements supported by two hinged frames and is characterised by a mechanism which allows the wheels of the front legs to touch the floor in both position said "bed" and "sofa. Moreover, said sofa bed comprises a mechanism which locks the rotation of the seat frame respect to the back frame and to obtain a lever which makes easier to convert the bed into a sofa.

Finally, according to a subsequent aim, the assembly of a spacing bar to the right and left sides is less difficult; this spacing bar is needed to provide a sufficiently rigid base for the bed.

7 Claims, 3 Drawing Sheets

SOFA BED COMPRISING INNOVATING MECHANISMS FOR POSITION ADJUSTMENT AND QUICK ASSEMBLY

TECHNICAL FIELD

The present invention relates to a sofa bed comprising innovating mechanisms for position adjustment and quick assembly. In the state of the technique, concerning the above mentioned applications, there are already many realizations of sofa bed adjustable in two or more positions. The firm, applying for the present application, holds other patents concerning similar mechanisms.

The known applications on the markets, however, present some drawbacks. In particular, they are not easy to use for the difficult adjustment and assembly procedures. In fact, due to kinematics, the settee front legs do not touch the floor when the forniture is used both as a sofa and as a bed. Up to now, to get round this disadvantage, the seat is tilted but this makes the settee uncomfortable. Moreover, the applications on the market require some energy to convert the bed into a sofa. Finally, the assembly of the structure, that supports the bed, is very difficult, as known from the technique.

DISCLOSURE OF THE INVENTION

The present invention solves the above mentioned problems thanks to fact that it is a sofa bed comprising innovating mechanisms for position adjustment and quick assembly. It comprises padding elements supported by two hinged frames and is characterised by a mechanism which allows the wheels of the front legs to touch the floor in both the positions said "bed" and "sofa".

Other aim of the invention is to comprise a mechanism which locks the rotation of the seat frame with respect to the back frame and to obtain a lever which makes easy to convert the bed into a sofa.

According to a subsequent aim, the assembly of a spacing bar to the right and left sides is less difficult; this spacing bar is needed to provide a sufficiently rigid base for the bed.

These and other advantages will be pointed out in the detailed description of the invention that will refer to the figures of the tables 1/3, 2/3 and 3/3, in which the preferred schemes of the invention are shown. All are examplifying and not restrictive.

WAY OF CARRYING OUT THE INVENTION

Figures 1A, 1B:
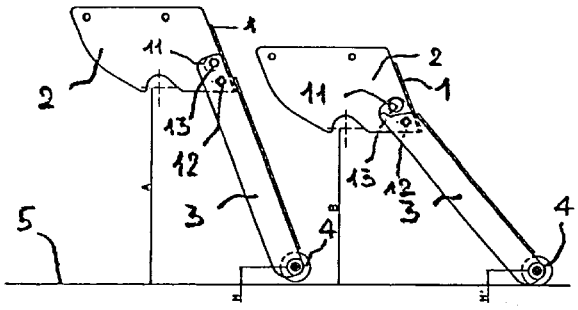
Figure 2A:
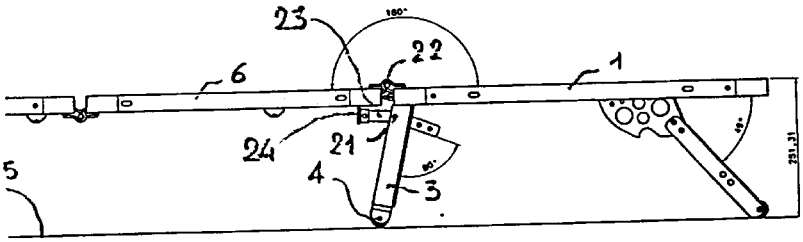
Figure 2B:
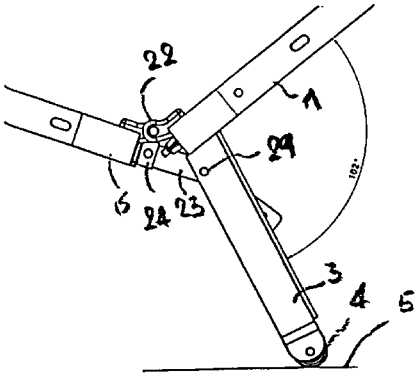
Figure 2C:
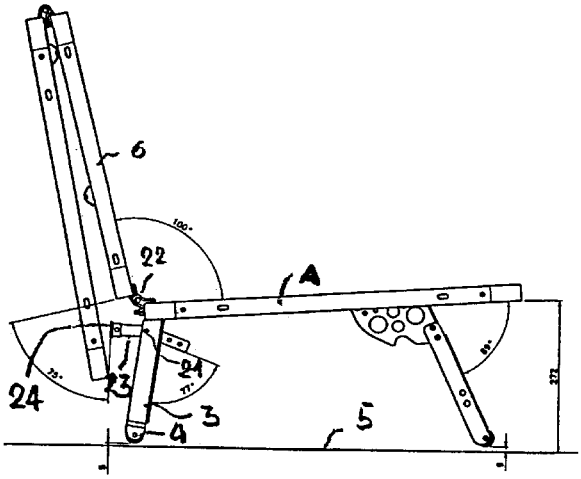
Figure 2:
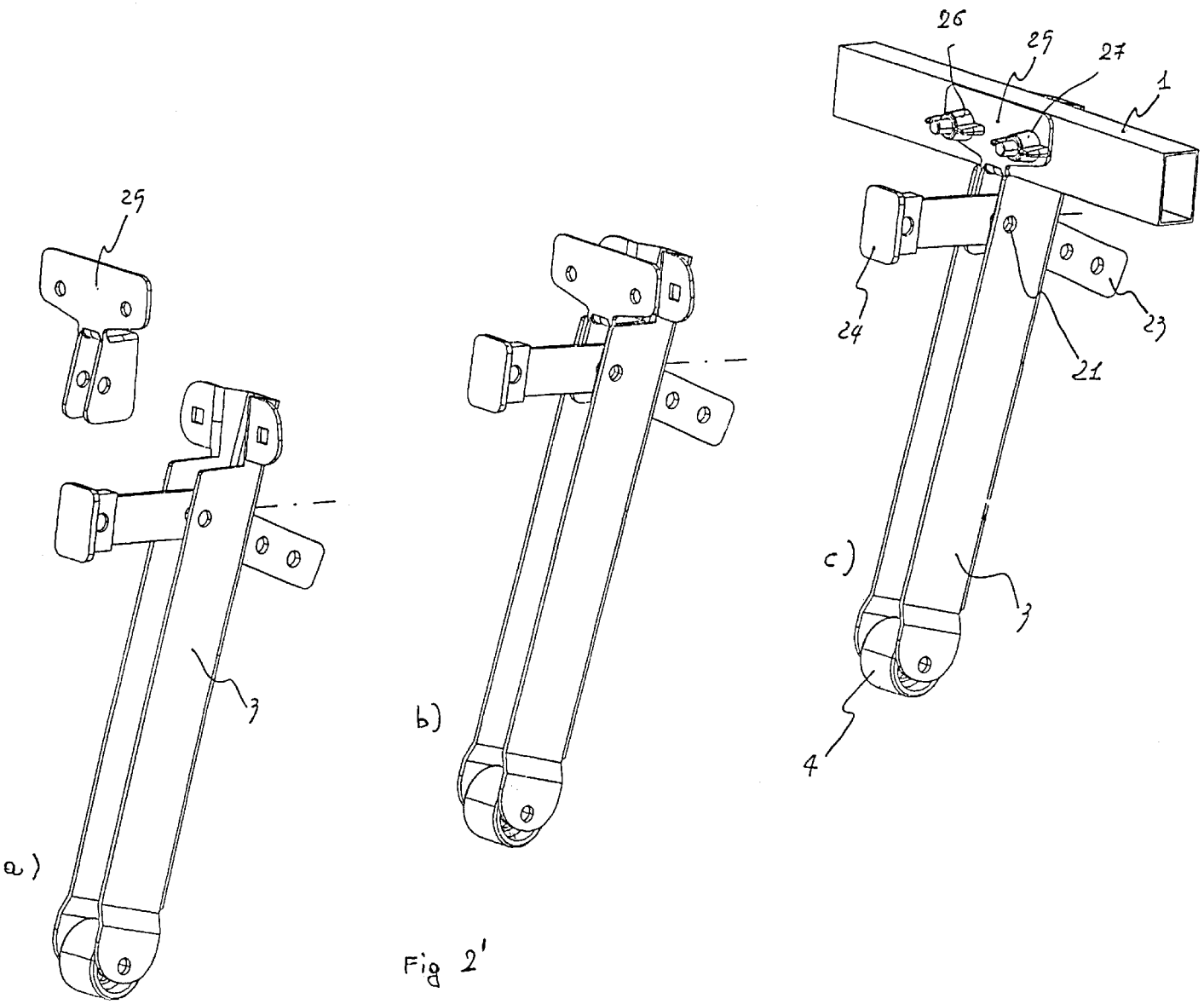

With reference to the above mentioned tables:

FIG. 1 shows the mechanism which allows the wheels of the front legs to touch the floor in both position said "bed" and "sofa", FIG. 2 represents the mechanism which makes easier the sofa closing procedure.

FIG. 2' shows a second embodiment of the mechanism which makes easier the sofa closing procedure.

Figure 3A:
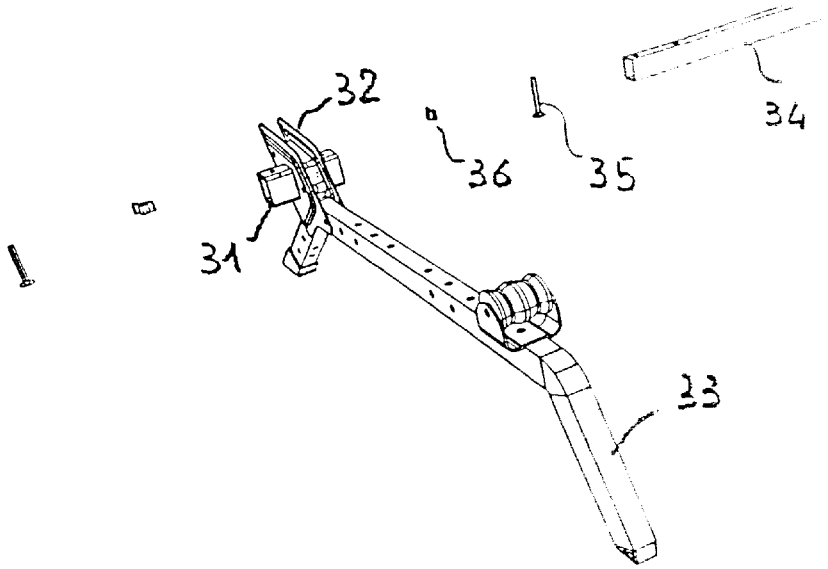
Figure 3B:
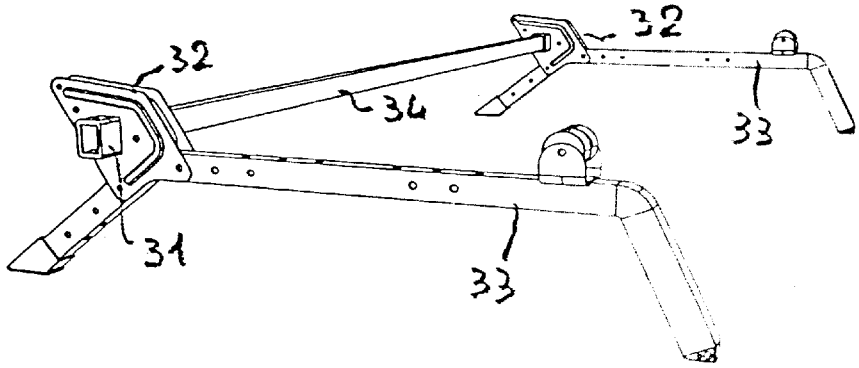

In FIG. 3, finally, the simplyfied assembly procedure of the sofa structure can be observed.

With reference to the FIGS. 1*a* and 1*b*, in which the two positions "sofa" and bed" are shown, said sofa bed comprises a mechanism which allows the wheels 4 of the front legs 3 to touch the floor 5 in both position said "bed" and "sofa"; said mechanism comprises a plate 2 constrained to the sofa seat frame 1. A slot 11 allows the leg 3 to rotate around the hinge 12, acting the pin 13 as a stop. Said rotation allows the wheels 4 to touch the floor 5 in both the functioning positions.

In FIG. 2, in the different positions, the mechanism which makes easier the sofa closing procedure is represented. In particular, said mechanism is constrained to seat frame 1 and allows the splinter bar 23 (hinged in 21 to the portion 3) to engage the back frame 6 (FIG. 2*b*). In such a way, the respective rotation of the frames 1 and 6 around the point 22 is prevented. The obtained lever, with rotation centre in the point where wheel 4 touches the floor 5, converts with small effort the frame 6 from the "bed" position to the "sofa" one. The push rod 24 acts as a loads distributor.

FIG. 2', in different assembly steps, represents a second possible embodiment of the above mentioned mechanism. In fact, the fork 25, which further engages the leg portion 3 in the point 21 and the seat frame 1 in the points 26 and 27, allows the mechanism to win in a easier way the torque acting during the sofa closing procedure.

Finally, in FIG. 3 is shown the quick assembly of a spacing bar 34 to the right and left sides, to provide sufficiently rigid base to mount the bed frame. The assembly is realised connecting the three parts by means of at least a couple of bolts 35 and nuts 36 (or by means of other suitable connections) without tools and with the minimum effort: the spacing bar 34 inside the pipe portion 31, with holes in axis; bolts 35 allow the final lock. The pipe portion 31 is engaged to two plates 32, which are joined to pipe 33, that forms the leg of the structure, said side. Said sides, in number of two and pre-assembled, are in this way assembled to the spacing bar ends.

What is claimed is:

1. A sofa bed comprising:

a seat frame;

a back frame pivotally connected to said seat frame;

a mechanism connecting said frames for enabling said frames to swing relatively from a bed position into a sofa position; and legs connected to said seat frame for supporting said seat frame and including front legs having wheels resting on said floor a plate connected to said seat frame and pivotally connected to said front legs, a slot formed in said plate, and a pin on said front legs engaging in said slot and forming a stop for said front legs enabling said wheels to rest on said floor in both of said positions.

2. The sofa bed defined in claim 1, further comprising further legs on a rear of said seat frame, said mechanism comprising a splinter bar pivotally connected to said further legs and engageable against an end of said back frame upon swinging of said back frame relative to said seat frame from said bed position into said sofa position.

3. A sofa bed as defined in claim 2 wherein said other legs are mounted to said seat frame by a fork having a plate connected to said seat frame at two points and received in a respective one of said other legs, a pivot pin for said splinter bar passing through said fork, said one of said other legs and said splinter bar.

4. The sofa bed defined in claim 1, further comprising:

a frame support having opposite sides composed of pipe;

respective plates affixed to said sides;

respective pipe sections extending through and attached to said plates;

a spacing bar passing through said pipe sections; and fasteners extending through holes in said bar and in said pipe sections for assembling said sides to said spacing bar.

5. A sofa bed comprising:

a seat frame;

a back frame pivotally connected to said seat frame;

a mechanism connecting said frames for enabling said frames to swing relatively from a bed position into a sofa position; and legs connected to said seat frame for supporting said seat frame and including front legs having wheels resting on said floor and further legs at a rear part of said seat frame, said mechanism comprising a splinter bar pivotally connected to said further legs and engageable against an end of said back frame upon swinging of said back frame relative to said seat frame from said bed position into said sofa position.

6. A sofa bed as defined in claim 5 wherein said other legs are mounted to said seat frame by a fork having a plate connected to said seat frame at two points and received in a respective one of said other legs, a pivot pin for said splinter bar passing through said fork, said one of said other legs and said splinter bar.

7. A sofa bed comprising:

a frame support having opposite sides composed of pipe;

respective plates affixed to said sides;

respective pipe sections extending through and attached to said plates;

a spacing bar passing through said pipe sections; and fasteners extending through holes in said bar and in said pipe sections for assembling said sides to said spacing bar.

* * * * *